US007559816B2

(12) United States Patent
Marshall

(10) Patent No.: US 7,559,816 B2
(45) Date of Patent: Jul. 14, 2009

(54) FLOTATION DEVICE

(76) Inventor: Douglas Marshall, 2840 Broadway, Oakland, CA (US) 94611

( * ) Notice: Subject to any disclaimer, the term of this patent is extended or adjusted under 35 U.S.C. 154(b) by 0 days.

(21) Appl. No.: 11/732,208

(22) Filed: Apr. 2, 2007

(65) Prior Publication Data

US 2008/0242170 A1 Oct. 2, 2008

(51) Int. Cl.
*B63C 9/08* (2006.01)

(52) U.S. Cl. ..... 441/108; 441/113

(58) Field of Classification Search ..... 441/108, 441/113

See application file for complete search history.

(56) References Cited

U.S. PATENT DOCUMENTS 2,017,868 A * 10/1935 Nolan ..... 441/112
4,011,614 A 3/1977 Bell
4,123,814 A 11/1978 Ettinger
5,030,153 A * 7/1991 Bailey ..... 441/115
5,219,308 A 6/1993 Rothhammer
5,382,184 A * 1/1995 DiForte, Jr. ..... 441/108
6,106,348 A 8/2000 Loisel
6,446,273 B1 * 9/2002 Gillen et al. ..... 2/455
6,582,267 B1 6/2003 Steger

* cited by examiner

*Primary Examiner*—Stephen Avila

(57) ABSTRACT

A flotation device including an elongated body portion with a substantially rectangular shape capable of fitting around a user's midsection. This elongated body portion is made of buoyant material and has an exterior shell made of substantially semi-elastic material. The semi-elastic material can be extended to form a tighter fit around the user's midsection. The flotation device of the present invention also includes at least two adjustable side straps attached to the elongated body portion. Each adjustable strap extends in a longitudinal direction and along the major dimension of the elongated body portion. These adjustable side straps can be adjusted for a tighter or looser fit around the midsection. The flotation device also features a two-part adjustable bottom strap having a first end attached to a front section of the elongated body portion, and having a second end attached to a back section of the elongated body portion. The first end and the second end can then be fastened through the user's legs to engage corresponding male and female buckles.

6 Claims, 2 Drawing Sheets

FLOTATION DEVICE

BACKGROUND OF THE INVENTION

The present invention relates generally to flotation devices and more specifically to flotation devices worn around a user's midsection.

Demand for water activities such water aerobics, kayaking, fishing, etc., continue to increase. Families and individuals enjoy such water activities particularly "theme park" activities like water sliding, splashing and other thrill seeking water rides. Many establishments mandate use of flotation devices for users' personal safety. Even without such requirement, many users desire to wear flotation devices to alleviate their fear of water.

Conventional flotation devices such as buoyant vests are well known. As implied by its name, a buoyant vest resembles a clothing vest and can be worn to provide buoyancy in the water. Buoyant vests have two armholes for receiving a user's arms and they can be worn around the shoulders and the chest similar to a clothing vest. Unfortunately many of these vests are uncomfortable particularly around the shoulders. They are either too large or too small for many users with potentially infinite sizes.

Although larger sized users can fit buoyant vests around the chest, these vests rarely fit around the torso. Also pot-bellied adults cannot comfortably fit conventional buoyant vests. Note that water activities also require considerable range of movement of the limbs and torso. Many conventional buoyant vests restrict the necessary range of movements for users engaging in such water activities. Another disadvantage of conventional buoyancy vests is that they rise up towards the user's face and become a choking hazard when users are in the water.

Other types of conventional flotation devices are also known. For example, one U.S. patent discloses an inflatable personal flotation device, which is readily inflated by a gas cartridge and which includes an oral inflation device. The device is attached to the wearer by a waist belt and anchor straps joined to a second belt attached directly to the bladder. A gas inlet nozzle is used for both the gas cartridge and oral inflation device. Although this flotation device could provide buoyancy levels, it loses comfort and simplicity because inflation is required.

Another U.S. patent discloses a water safety device of buoyant material which is fitted by waist measurement around the user's waist to provide flotation. Contoured ribs of buoyant material on the inside of the device fit under the wearer's ribs, and openings in various positions of the device provide stabilization of the position of a wearer when in the water. One disadvantage of this water safety device is that the contoured ribs of buoyant material can cause discomfort by digging into the users' ribs or midsection. Because users come in many different sizes, it is also infeasible to provide different sized contoured ribs at different positions commensurate with such different sized users.

There is a need to address one or more of the foregoing disadvantages of conventional flotation devices and the present invention meets this need.

BRIEF SUMMARY OF THE INVENTION

Various aspects of a flotation device can be found in exemplary embodiments of the present invention. In a first embodiment, the flotation device includes an elongated body portion with a substantially rectangular shape capable of fitting around a user's midsection. This flotation device is comfortable and unlike convention buoyancy vests and jackets, the flotation device has neither armholes nor shoulder portions thus eliminating the need for wearing around the shoulder and chest.

With only the need for minor modification in length and width, the flotation device of the present invention can substantially conform to the user's mid-section so that size is less of an issue. Larger sized and pot-bellied adults can also fit the present invention without torso restrictions associated with conventional devices. Another advantage of the present invention is that users' arms are also free of restraint and since water activities also require considerable range of movement of the limbs and torso, the present invention can allow for such range of movement.

The elongated body portion is made of buoyant material and has an exterior shell made of substantially semi-elastic material. This provides a simple mechanism for buoyancy without complex inflatable cartridges of conventional flotation devices. The semi-elastic material can be extended to form a tighter fit around the user's midsection.

The flotation device of the present invention also includes at least two adjustable side straps attached to the elongated body portion. Each adjustable strap extends in a longitudinal direction and along the major dimension of the elongated material. These adjustable side straps can be adjusted for a tighter fit around the midsection. The flotation device also features a two-part adjustable bottom strap having a first part attached to a front section of the elongated body portion, and having a second part attached to a back section of the elongated body portion. The first and second parts can then be fastened through the user's legs to engage corresponding male and female buckles.

The adjustable bottom straps in addition to the adjustable side straps further ensures that elongated body portion does not rise up away from the midsection toward the user's head thus avoiding potential choking hazards. Although tests have confirmed that the adjustable side straps are sufficient to retain flotation device around the user's midsection, the adjustable bottom straps can also be employed as additional feature to ensure the elongated body portion is retained in position. Thus, unlike the prior art that uses contoured ribs of buoyant material on the inside of the flotation device against the wearer's ribs, which can cause great discomfort to the ribs, the present invention employs adjustable straps to retain the position of flotation device with little or no discomfort.

An understanding of the nature and advantages of the present invention herein may be realized by reference to the remaining portions of the specification and the attached drawings. Further features and advantages of the present invention, as well as the structure and operation of various embodiments of the present invention, are described in detail below with respect to the accompanying drawings. In the drawings, the same reference numbers indicate identical or functionally similar elements.

DETAILED DESCRIPTION OF THE INVENTION

Reference will now be made in detail to the embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
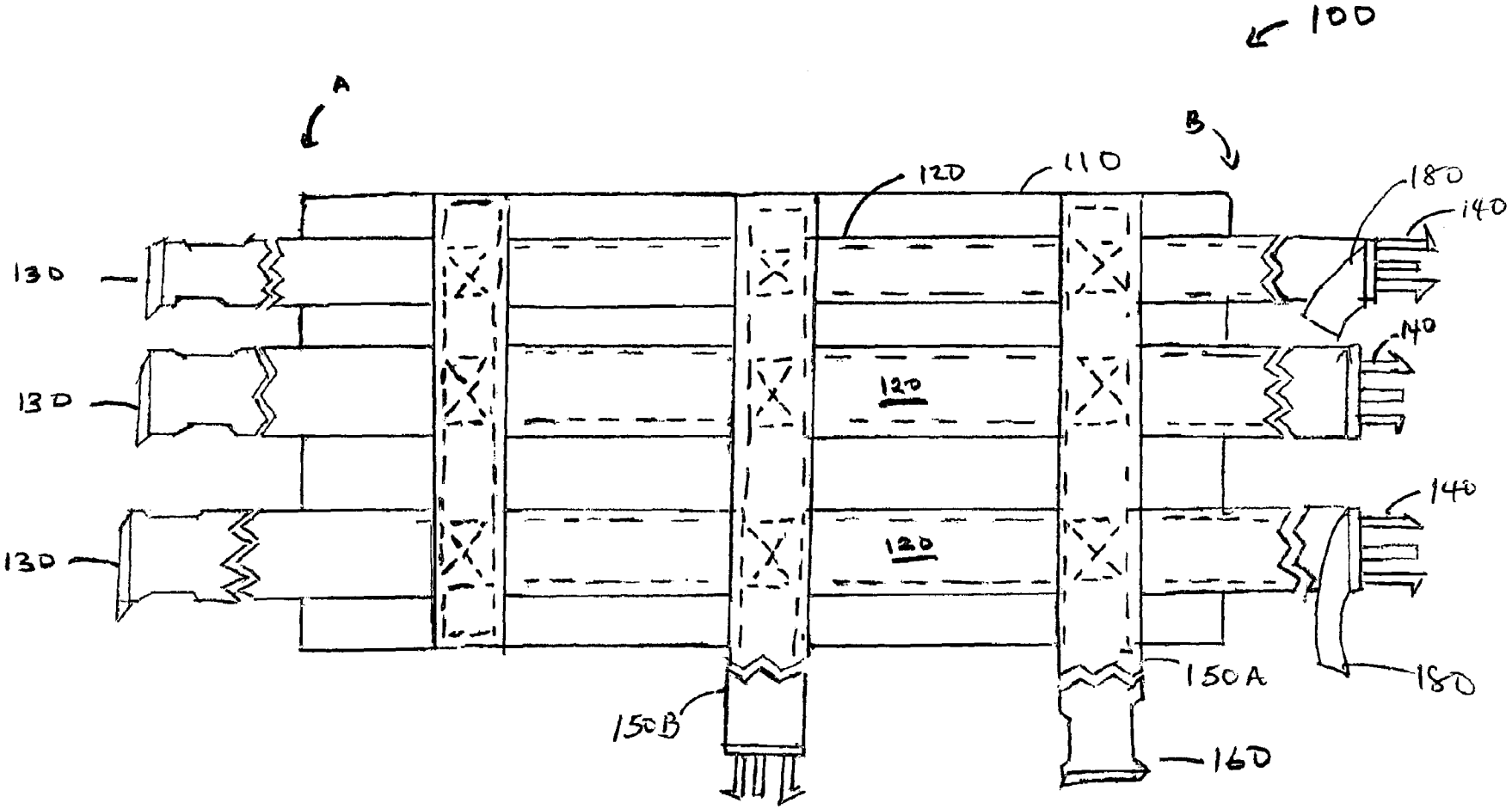
FIG. 1 is an elevation view of flotation device in accordance with an exemplary embodiment of the present invention.

FIG. 1 is an elevation view of flotation device 100 in accordance with an exemplary embodiment of the present invention.

In FIG. 1, among other components, flotation device 100 comprises elongated body portion 110 and one or more adjustable side straps 120. Although not shown, more or less adjustable side straps 120 can be employed as proves necessary for the invention. Each adjustable side strap 120 includes female buckle 130 and corresponding male buckle 140.

As shown, flotation device 100 further includes a two-part adjustable bottom strap, adjustable bottom strap 150A and adjustable bottom strap 150B. Adjustable bottom strap 150A includes female buckle 160 and its counterpart adjustable bottom strap 150B includes male buckle 170. In use, a user intending to engage in water activities such as water aerobics, etc. simply places flotation device 100 around the user's waist. The user then engages male buckle 140 and corresponding female buckle 130. Attached straps can then be adjusted for a looser or tighter fit as desired.

In more detail, elongated body portion 110 can substantially fit around the user's midsection. It is substantially rectangular in shape and its dimension can vary depending on the size of flotation device 100. The length and width of a typical medium-sized elongated body portion may be 38" and 10" respectively. Light-weight and buoyant material such as closed cell foam material in chopped, molded or sheet form or kapok is used for elongated body portion 110. In one embodiment, this buoyant material may be about 1" thick. Elongated body portion 110 further comprises a shell made of substantially semi-elastic material. In this manner, the shell can be stretched for a snug fit around the user's midsection. This shell can be scuba fabric, nylon swatch, polypropylene woven fabrics or the like. One of ordinary skill in the art will realize that these are but examples and other suitable materials consistent with the scope of the present invention can be utilized for the shell and elongated body portion 110.

Adjustable side straps 120 straps can be adjusted for a tighter or looser fit around the midsection as desired. Adjustable side straps 120 attached to elongated body portion 110 extend in a longitudinal direction along the major dimension (length) of elongated body portion 110. Specifically, in FIG. 1, each side strap 120 begins at proximal end A and terminates at distal end B. The proximal end includes female buckle 130 and the distal end includes male buckle 140. Although shown with buckles, the adjustable straps can be utilized with male and female Velcro fasteners.

Adjustable bottom strap 150A and 150B retain elongated body portion 110 around the midsection to prevent this elongated body portion from rising toward the user's face when the user is in water. Each adjustable bottom strap 150A and 150B runs in a latitudinal direction along the minor dimension of elongated body portion 110. They also run at substantial right angles to adjustable side straps 120. Adjustable bottom strap 150A is attached to a front section (distal end B) of elongated body portion 110, and adjustable bottom strap 150B is attached to a back (middle) section of elongated body portion 110.

Adjustable bottom strap 150A and 150B can be coupled through the user's legs to prevent elongated body portion 110 from rising up and away from the user's midsection when elongated body portion 110 is in water. Preferably all adjustable straps are attached to elongated body portion 110 by stitching; cross-stitching is further employed where two straps intersect. Although not shown, additional bottom straps running at various angles relative to the adjustable side straps can be employed.

Figure 2:
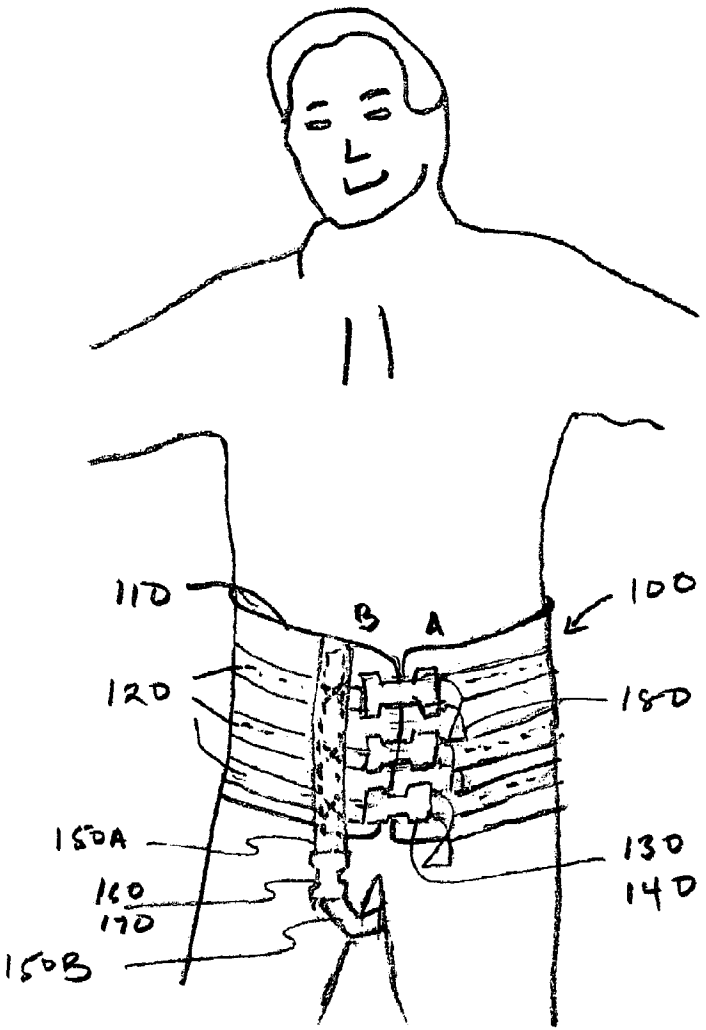
FIG. 2 illustrates a flotation device around the midsection of a user according to an exemplary embodiment of the present invention.

FIG. 2 illustrates flotation device 100 around the midsection of a user according to an exemplary embodiment of the present invention.

In use, as shown, a user intending to engage in water activities such kayaking, water aerobics, fishing, or "theme park" activities involving water sliding, splashing and other thrill seeking water rides begins by placing flotation device 100 around the user's waist. Flotation device 100 is encircled around the midsection much like a belt such that proximal end A and distal end B are brought together at the user's abdomen. Each male buckle 140 and corresponding female buckle 130 can then be engaged to fasten the flotation device. Strap 180 can then be loosened or tightened according to the user's wishes.

In this manner, the present invention avoids the disadvantage of conventional buoyant vests since it can fit around users' mid-sections. There are no armholes thus eliminating the need for wearing around the shoulders. Size is also less an issue because flotation device 100 is substantially rectangular in shape, fitting around the midsection and beneath the underarm area. With only the need for minor variations in length and width, flotation device 100 can substantially conform to the user's mid-section. Users' arms are also free of restraint and since water activities also require considerable range of movement of the limbs and torso, the present invention can allow for such range of movement. Larger sized and pot-bellied adults can also fit the present invention without torso restrictions associated with conventional devices.

Another advantage of the present invention is its simplicity in providing necessary flotation without inflatable gas cartridges. Since elongated body portion 110 is made of light-weight and buoyant material such as closed cell foam and since this buoyant material is underwater when the user is in the water, flotation device 100 provides the requisite amount of buoyancy without the complexity associated with conventional inflatable devices.

Adjustable bottom strap 150A and adjustable bottom strap 150B can also be fastened by inserting male buckle 170 through the user's legs to engage female buckle 160. Although optional, this step further ensures that elongated body portion 110 does not rise up away from the midsection toward the user's head thus avoiding potential choking hazards. Although tests have confirmed that adjustable side straps 120 are sufficient to retain flotation device 110 around the user's midsection, adjustable bottom straps 150A and 150B can also be employed as additional security to ensure elongated body portion 110 is retained in position. Thus, unlike prior art devices that use contoured ribs of buoyant material on the inside of the device and under the wearer's ribs, which can cause great discomfort, the present invention employs adjustable straps to retain the position of flotation device 100 with little or no discomfort.

Figure 3:
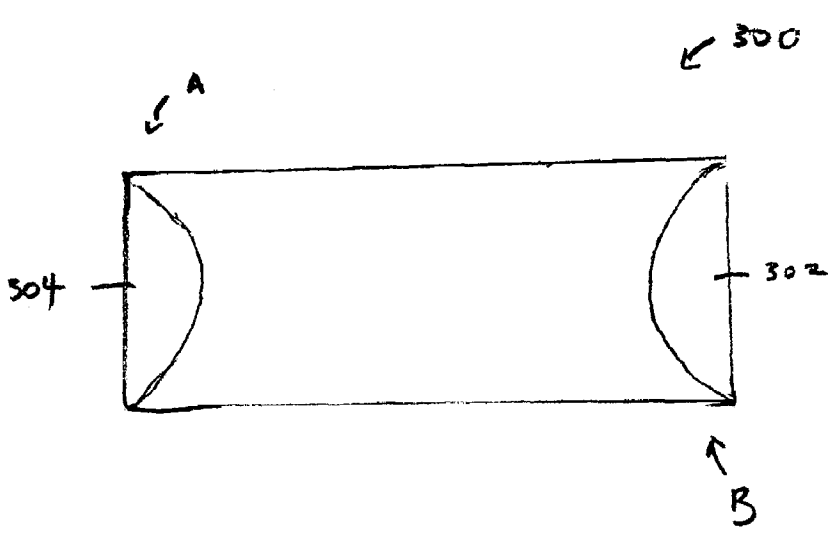
FIG. 3 illustrates a flotation device according to an exemplary embodiment of the present invention.

FIG. 3 illustrates a flotation device 300 according to an exemplary embodiment of the present invention.

In FIG. 3, flotation device 300 has beveled end 304 and beveled end 302 for smooth overlap when the straps (not shown) attached to the beveled ends are engaged. This also creates for a smooth transition of the flotation device ends at the abdomen.

While the above is a complete description of exemplary specific embodiments of the invention, additional embodiments are also possible. Thus, the above description should not be taken as limiting the scope of the invention, which is defined by the appended claims along with their full scope of equivalents.

I claim:

1. A flotation device comprising:

an elongated body portion capable of substantially fitting around a user's midsection, wherein said elongated body portion has an interior, and substantially all of said interior is comprised of lightweight and buoyant material, and wherein said interior of said elongated body portion is non-inflatable, wherein said elongated body portion has an exterior made of substantially semi-elastic material, wherein said semi-elastic material is located substantially around the user's midsection area and wherein said semi-elastic material is configured to be stretched around the user's midsection;

at least two adjustable side straps attached to the elongated body portion, each adjustable side strap extending in a longitudinal direction along the major dimension of said elongated material, wherein said adjustable side straps can be adjusted for a tighter or looser fit around the midsection; and a least one adjustable bottom strap having a first end attached to a front section of said elongated body portion, wherein said adjustable bottom strap has a second end attached to a back section of said elongated body portion, wherein said first end and said second end can be fastened through the user's legs to prevent said elongated body portion from rising up away from the user's midsection when said elongated body portion is immersed in water.

2. The flotation device of claim 1 wherein said elongated body portion has a proximal end and a distal end, and wherein the proximal end and the distal end are beveled to permit overlap of both ends.

3. The flotation device of claim 1 wherein each of said adjustable side and bottom straps is stitched to said elongated body portion.

4. The flotation device of claim 1 wherein the first end and the second end comprises a male and a female buckle respectively.

5. The flotation device of claim 1 wherein the first end and the second end comprises a male and a female fastening means respectively.

6. A method for using a flotation device to provide flotation to a user in water, the flotation device having an elongated body portion said elongated body portion having an interior, wherein substantially all of said interior is comprised of lightweight and buoyant material and having an exterior made of substantially semi-elastic material, said elongated body portion having at least two adjustable side straps attached therein, each adjustable strap extending in a longitudinal direction and along the major dimension of said elongated material, and said elongated body portion having at least one adjustable bottom strap attached therein, wherein said adjustable bottom strap has a first end attached to a front section of said elongated body portion and has a second end attached to a back section of said elongated body portion, said method comprising:

placing the elongated body portion substantially around the user's midsection, said elongated body portion having said semi-elastic material located around the user's midsection area;

adjusting the adjustable side straps so that said elongated body portion is tighter or looser around the user's midsection and fastening said adjustable side straps; and fastening the first end and the second end of said adjustable bottom straps through the user's legs to prevent said elongated body portion from rising up away from the user's midsection when said elongated body portion is immersed in water.

* * * * *